US006003322A

United States Patent [19]

Graham

[11] Patent Number: 6,003,322

[45] Date of Patent: Dec. 21, 1999

[54] METHOD AND APPARATUS FOR SHIPPING SUPER FROZEN MATERIALS

[75] Inventor: B Eric Graham, Newton, Mass.

[73] Assignee: Coldwave Systems LLC, Newton Center, Mass.

[21] Appl. No.: 08/954,644

[22] Filed: Oct. 20, 1997

[51] Int. Cl.[6] ..... F25D 31/00

[52] U.S. Cl. ..... 62/52.1; 62/53.2; 62/239; 62/384

[58] Field of Search ..... 62/52.1, 53.2, 62/384, 385, 388, 239

[56] References Cited

U.S. PATENT DOCUMENTS

| | | | |
|---|---|---|---|
| 3,695,056 | 10/1972 | Glynn et al. . | |
| 4,399,658 | 8/1983 | Nielson . | |
| 4,502,293 | 3/1985 | Franklin, Jr. . | |
| 4,580,411 | 4/1986 | Orfitelli . | |
| 4,825,666 | 5/1989 | Saia, III . | |
| 4,891,954 | 1/1990 | Thomsen . | |
| 4,947,658 | 8/1990 | Wheeler et al. | 62/384 X |
| 4,991,402 | 2/1991 | Saia, III . | |
| 5,125,237 | 6/1992 | Saia, III . | |
| 5,320,167 | 6/1994 | Johnson et al. | 62/239 X |
| 5,363,670 | 11/1994 | Bartilucci . | |
| 5,406,803 | 4/1995 | Casto, II | 62/52.1 |
| 5,598,713 | 2/1997 | Bartilucci . | |
| 5,638,697 | 6/1997 | Reznikov et al. | 62/384 X |
| 5,787,719 | 8/1998 | Wilson | 62/239 X |
| 5,791,150 | 8/1998 | Bosher et al. | 62/384 X |

*Primary Examiner*—Christopher B. Kilner
*Attorney, Agent, or Firm*—Sampson & Associates

[57] ABSTRACT

A method and apparatus for freezing products or materials to a super-frozen state, storing them until shipment and shipping them in a super-frozen state. The apparatus consists of two self-contained, super-insulated containers. The first apparatus has at least two compartments, one for freezing and one for storage. The product or material to be frozen is placed in the freezing compartment and frozen to a super-frozen state and then transferred to the storage compartment where it is stored until shipment. The second apparatus is a self contained super-insulated shipping container. When shipment is to be effected, product or material is transferred from a storage compartment of the first apparatus in a super-frozen state to the second or shipping apparatus. The doors of the shipping apparatus are closed and the self-contained, super-insulated apparatus containing super-frozen product or material is shipped to a remote venue.

26 Claims, 3 Drawing Sheets

METHOD AND APPARATUS FOR SHIPPING SUPER FROZEN MATERIALS

BACKGROUND

1. Field of Invention

This invention relates to a method and apparatus for shipping, storing and freezing super frozen perishable materials in a self-contained shipping container which maintains the perishable material below −50° C. and which is super insulated and has its own cryogenic-based refrigeration system.

2. Background Information

Freezing and Storage

Commercial fishing is a worldwide enterprise generating billions of dollars in sales on an annual basis. With modern shipping and storage technology, fish caught nearly anywhere in the world can be efficiently frozen and subsequently transported to almost any market in the world for consumption thereof.

Particular products however, do not lend themselves to conventional freezing and shipping methods. In particular, fish intended for consumption in an uncooked or raw state such as sushi, generally cannot be frozen using conventional equipment, without adversely affecting the quality, i.e., color and taste thereof. For this reason, fish intended for use as sushi generally must be caught locally so it can be brought to market relatively quickly without freezing. This necessity has tended to limit the supply of fish available for sushi to effectively increase the price thereof relative to frozen fish. This phenomenon tends to produce a relatively large disparity between the price of sushi-grade fish and non-sushi grade (i.e., frozen) fish in the marketplace.

In a recent attempt to address this disparity, some commercial fishing enterprises have harvested fish, such as tuna and the like, in areas of the world where there is little local demand for sushi-grade product (and thus a substantially lower market value therefor), and transported the product at cryogenic (i.e., super-cooled) temperatures of less than −40 degrees C. to the sushi markets. It has been found that at these temperatures tuna and the like maintain suitable freshness for sushi purposes to thus retain the relatively high quality and premium prices associated with sushi-grade product. This approach has generally required dedicated use of cargo ships known as super carrier vessels, outfitted with specialized refrigeration equipment specifically designed to maintain a constant cryogenic temperature of about −60 degrees C. The expense of such vessels typically dictates their use only when a substantially full shipment of approximately 100 metric tons (100,000 kilograms) or more of product is available for shipment. Accordingly, in order to satisfy this relatively high minimum volume requirement, such ships must generally remain at port or in the vicinity of tuna fishing fleets for extended periods of time as the fish are harvested and prepared for shipment. Disadvantageously, this aspect generally limits the number of trips from the fishing ports to the sushi markets to approximately one or two trips per year. For many perishable products this high volume requirement and low trip frequency renders this approach impractical. For many products which are in demand, the time required for shipment on a super carrier vessel, often several months from harvest to arrival at the destination, further makes such a shipping method undesirable.

Smaller shipments of conventionally frozen (i.e., 0 to −26 degrees C.) product have been shipped utilizing standard ISO containers on conventional transport ships. These ISO containers are relatively plentiful and the conventional transport ships travel on a relatively frequent basis to most desired destinations. These containers are typically refrigerated by use of mechanical refrigeration units associated with each individual ISO container. These refrigeration units, however, have not been capable of providing refrigerated temperatures of less than about −25 degrees C. Moreover, such mechanical units are prone to mechanical failure, in which about 5 to 10 percent of shipments are lost due to spoilage primarily due to mechanical breakdown and human error. Such units are also relatively expensive, generally costing on the order of $8000 to $10,000 for the container, an additional $10,000 to $12,000 for each refrigeration unit plus another $10,000 to $12,000 for an electric generator (i.e., genset) to provide electric power for the refrigeration unit. A further drawback of these mechanically refrigerated containers is that they generally must be transported on ships equipped for "reefer" (i.e., refrigerated) shipments, i.e., on ships capable of providing a continuous supply of fuel and/or electricity to the containers and including technicians capable of servicing the units in the event of a failure en-route. Shipping rates for such reefer containers tend to be considerably higher than rates for "dry" containers (i.e., those not requiring such services) of comparable size and weight.

Moreover, it has also been recognized that shipping rates for standard ISO shipping containers are significantly lower than for similarly sized and shaped containers which are not ISO compliant. For example, a standard 40 foot ISO shipping container which may cost $2,000 (U.S.) to ship, may cost up to $15,000 if not ISO compliant. This discrepancy is due largely to the ability to stack shipping containers which have been certified to comply with ISO standards with respect to size, shape, structural integrity, and/or ability to interlock to one another.

Other conventional refrigerated transportation devices include ISO containers which are filled with product and injected with liquid gas (such as $CO_2$) to form dry ice which maintains the product in a frozen state for the duration of the transport. A drawback of this approach, is that in the event a trip is delayed, etc., the dry ice may evaporate prior to reaching the destination, to result in a spoiled shipment. In particular, the insulative value of standard ISO containers tends to be insufficient to enable shipments of more than a few days in duration. Moreover, such containers have generally been unable to maintain product at the aforementioned cryogenic, super-frozen temperatures. Rather, such containers, which utilize $CO_2$ and the like, have been used to ship standard frozen products which only require refrigeration to approximately −10 degrees C. Although the dry ice has a frozen temperature of approximately −50 to −60 degrees C., such containers generally provide an oscillating temperature environment during shipment. For example, fresh product is typically loaded into a container and liquid $CO_2$ is then injected to form dry ice at about −78 degrees C. at sea level. The dry ice thus gradually freezes the product bringing the product temperature from ambient temperature down to about 40 to −50 degrees C. until the $CO_2$ has sublimated at which time the product begins to increase in temperature during transport. The duration of the shipment is timed so that the container arrives at the destination before the product temperature exceeds about −10 degrees C. This approach thus provides an oscillatory, rather than the desired steady state shipment temperature.

It is thus desirable to provide a device and method for enabling shipment of product in conventional bulk shipping containers on board conventional shipping vessels at a steady state super-frozen temperature. For freezing there are presently other cryogenic systems available, but they are difficult to ship and they are very expensive. Furthermore, they must be housed inside a building which can greatly increase the cost. The suitable for freezing but provides no place to store the products after freezing. Thus, a large storage freezer must be built which again is associated with a substantial cost. Once built the separate freezing and storage systems are inflexible. In other words it cannot easily be picked up and moved to another part of the world. If the nature of the business changes, a large super freezer facility can become un-usable in that location and therefore of no value. The system of the present invention will retain it's value in that it can be easily shipped to another location and/or sold.

A variety of shipping, storing and freezing devices using $CO_2$ and $N_2$ have been used for perishable products. However these devices are designed to maintain product at about −20° C. and are unable to maintain super frozen product at temperatures in the range of −50 to −60° C. These devices include Carbon Dioxide Refrigeration Systems (U.S. Pat. No. 3,695,056: Glynn; E. P. and Hsu; H. L.), Refrigeration system with carbon dioxide injector (U.S. Pat. No. 4,399,658: Nielsen; D. M.), Container $CO_2$ cooling system (U.S. Pat. No. 4,502,293: Franklin Jr.; P. R.), Liquid nitrogen freezer (U.S. Pat. No. 4,580,411: Orfitelli; J. S.), Portable self-contained cooler/freezer apparatus for use on common carrier type unrefrigerated truck lines and the like (U.S. Pat. No. 4,825,666: Saia, Ill; L. P.), Refrigerated container (U.S. Pat. No. 4,891,954: Thomsen; V. E.), Portable self-contained cooler/freezer apparatus for use on common carrier type unrefrigerated truck lines and the like (U.S. Pat. No. 4,991,402: Saia, III; L. P.), Portable self-contained cooler/freezer apparatus for use on airplanes, common carrier type unrefrigerated truck lines and the like (U.S. Pat. No. 5,125,237: Saia, III; L. P.), Self-contained cooler/freezer apparatus (U.S. Pat. No. 5,262,670: Bartilucci; A.), Portable self-contained cooler/freezer apparatus with nitrogen environment container (U.S. Pat. No. 5,598,713: Bartilucci; A. R.).

All of the above apparatus are characterized by the ability to cool or freeze perishable material down to about the temperature of approximately −20° C. This is adequate and even desirable for some applications. However, for materials that require super freezing at temperatures of approximately −60° C. such apparatus are unable to fulfill the requirements. In addition, all of the above apparatus are characterized by a division into two compartments. The first of these compartments contains the perishable material, the second of these compartments contains the cooling agent ($CO_2$ or $N_2$). Cooling is accomplished by the cooling agent moving from the second to the first compartment via a venting system.

Shipping

SUMMARY OF THE INVENTION

An important aspect of the present invention was the realization that cryogenic gas systems may be effectively utilized to freeze, store and ship product at a relatively constant super-frozen temperature (i.e., about −50 to −60 degrees C.), rather than the oscillatory temperatures associated with conventional shipping containers refrigerated with cryogenic gas. It was realized that such may be accomplished by separating the functions of freezing and shipping in a manner contrary to common practice in the cryogenic gas refrigeration market. In this regard, it was realized that once the product has been frozen to the super-frozen temperature, a modular shipping container sized and shaped to ISO standards and in accordance with the present invention, may be devised to form a modular, self-contained shipping container refrigerated with cryogenic gas, which effectively maintains a steady state temperature of −50 degrees C. or less for extended periods of time such as associated with standard transport along major shipping routes, i.e., 30 days or more. The present invention thus enabled, for the first time, super-frozen product to be shipped in standard sized bulk shipping containers, rather than the relatively large (i.e., entire ship) volumes associated with prior art super-carrier vessels. This advantageously permitted shipment of product in a relatively steady stream of smaller shipments, rather than only the larger quantity that had been amassed. In addition, the present invention advantageously enables shipment as a "dry", rather than a "reefer" container, for substantial savings in both shipment cost and environmental (i.e., pollution) impact.

In a further aspect of the present invention, a self-contained, portable freezer fabricated as one or more components having standard ISO shipping container dimensions, is provided. Advantageously, this freezer may be conveniently shipped along with the shipping container of the invention to the location where the product (i.e., fish) is being harvested. This location may be on board a fishing vessel, or at a nearby port. Such portability overcomes the disadvantage associated with the inflexibility of permanent, land based, freezing and storage systems developed for use at super-frozen temperatures with the super-carrier vessels. Moreover, the portable freezer of the present invention has a relatively high product throughput, and may include an integral storage section to store the super-frozen product while it awaits loading into the shipping container of the present invention.

Advantageously, the freezer and shipping container of the present invention eliminate the need for a large storage device such as typically associated with the land based freezers of the prior art, since large quantities of product do not need to be amassed while awaiting shipment on super-carrier vessels. Thus, the present invention provides a portable, modular system which provides a flexible and efficient means for providing a "cryogenic cold chain", which extends nominally continuously from harvest to consumption of the product.

The present invention thus enables the product to be frozen, stored and shipped nominally as it is harvested, for substantially "just in time" (JIT) delivery pursuant to customer requirements, to minimize storage expense incurred by the fishing fleet, shipper and/or customer and to increase the speed with which the product is brought to market.

The present invention also advantageously enables sushi wholesalers and/or retailers to purchase in relatively small quantities directly from fish suppliers, rather than through intermediaries who typically coordinate larger super-carrier shipments. Such elimination of "middlemen" may further reduce the cost to the ultimate consumer.

In a first aspect of the present invention, an apparatus is provided for shipping product disposed at a super-frozen temperature of less than or equal to about −50 degrees C. The apparatus includes a container having walls insulated to an r-value greater than or equal to about 20, a spray head disposed within the container to spray cryogenic fluid, and at least one coupling in fluid communication with the spray head, the coupling being adapted for alternate engagement and disengagement with an external cryogenic fluid supply. The container is selectively sealable to form a self-contained, dry module. The container receives product at the super-frozen temperature and maintains the product at the super-frozen temperature during shipment thereof.

In a second aspect of the present invention, a method is provided for shipping product at a super-frozen temperature of less than or equal to about −50 degrees C. The method includes the steps of:

(a) providing product at the super-frozen temperature;

(b) providing a modular shipping container adapted to maintain the product at the super-frozen temperature, the modular shipping container having:

walls insulated to an r-value greater than or equal to about 20;

a spray head disposed therein;

at least one coupling disposed in fluid communication with the spray head;

the container being selectively sealable to form a self-contained, dry module;

(c) placing the product into the modular shipping container;

(d) engaging an external cryogenic fluid supply with the at least one coupling, wherein cryogenic fluid is communicated from the external cryogenic fluid supply to the spray head and discharged into the container onto the product;

(e) disengaging the external cryogenic fluid supply from the at least one coupling;

(f) sealing the container to form a self-contained, dry module; and (g) transporting the modular shipping container to a destination, wherein the product is provided at the destination at the super-frozen temperature.

In a third aspect of the present invention, a portable, modular apparatus is provided for freezing and storing fish at a super-frozen temperature of less than or equal to about −50 degrees C., to preserve the fish at sushi-quality. The apparatus includes one or more containers, a refrigeration system located integrally with the one or more containers, the refrigeration system being adapted to freeze product disposed within the apparatus to the super-frozen temperature. The apparatus is adapted for being shipped to a destination for deployment at the destination to freeze and store fish at the super-frozen temperature, and for being subsequently re-shipped to another destination for re-deployment.

In a fourth aspect of the present invention, a method is provided for freezing and storing fish at a super-frozen temperature of less than or equal to about −50 degrees C., to preserve the fish at sushi-quality. The method includes the steps of:

(a) providing a modular, portable apparatus including:

one or more containers;

a refrigeration system disposed integrally with the one or more containers, the refrigeration system being adapted to freeze product disposed within the apparatus to the super-frozen temperature;

the portable apparatus adapted for being shipped to a destination for deployment at the destination to freeze and store fish at the super-frozen temperature, and for being subsequently reshipped to an other destination for re-deployment;

the one or more containers having a first section adapted for freezing the fish and a second section adapted for storing the fish at the super-frozen temperature;

(b) loading the fish into the first section and retaining the fish therein until the fish reaches the super-frozen temperature; and (c) transferring the fish from the first section to the second section, wherein the fish are maintained at the super-frozen temperature in a substantially preserved state suitable for subsequent consumption as sushi.

A fifth aspect of the present invention includes a method for providing sushi-quality fish harvested at a first location, to a distinct second location. The method includes the steps of:

(a) providing a portable, modular freezer adapted to freeze fish to a super-frozen temperature of less than or equal to about −50 degrees C.;

(b) transporting the modular freezer to the first location;

(c) loading the harvested fish into the modular freezer and retaining the fish within the modular freezer until the fish reaches the super-frozen temperature;

(d) providing a modular shipping container adapted to maintain the fish at the super-frozen temperature;

(e) transferring the fish from the modular freezer to the modular shipping container; and (f) shipping the modular shipping container to the second location, wherein the fish are provided at the second location at the super-frozen temperature in a substantially preserved state suitable for use as sushi.

PREFERRED EMBODIMENT

Description

Herein we describe a specific embodiment which is the preferred embodiment. While the invention is susceptible to various modifications and alternative forms, this specific and preferred embodiment is shown by way of the drawings and the detailed description herein described. It should be understood, however, that there is no intent to limit the invention to the particular form disclosed, but on the contrary, the intention is to cover all modifications, equivalents, and alternatives falling within the spirit and scope of the invention as defined by the appended claims.

Figure 1:
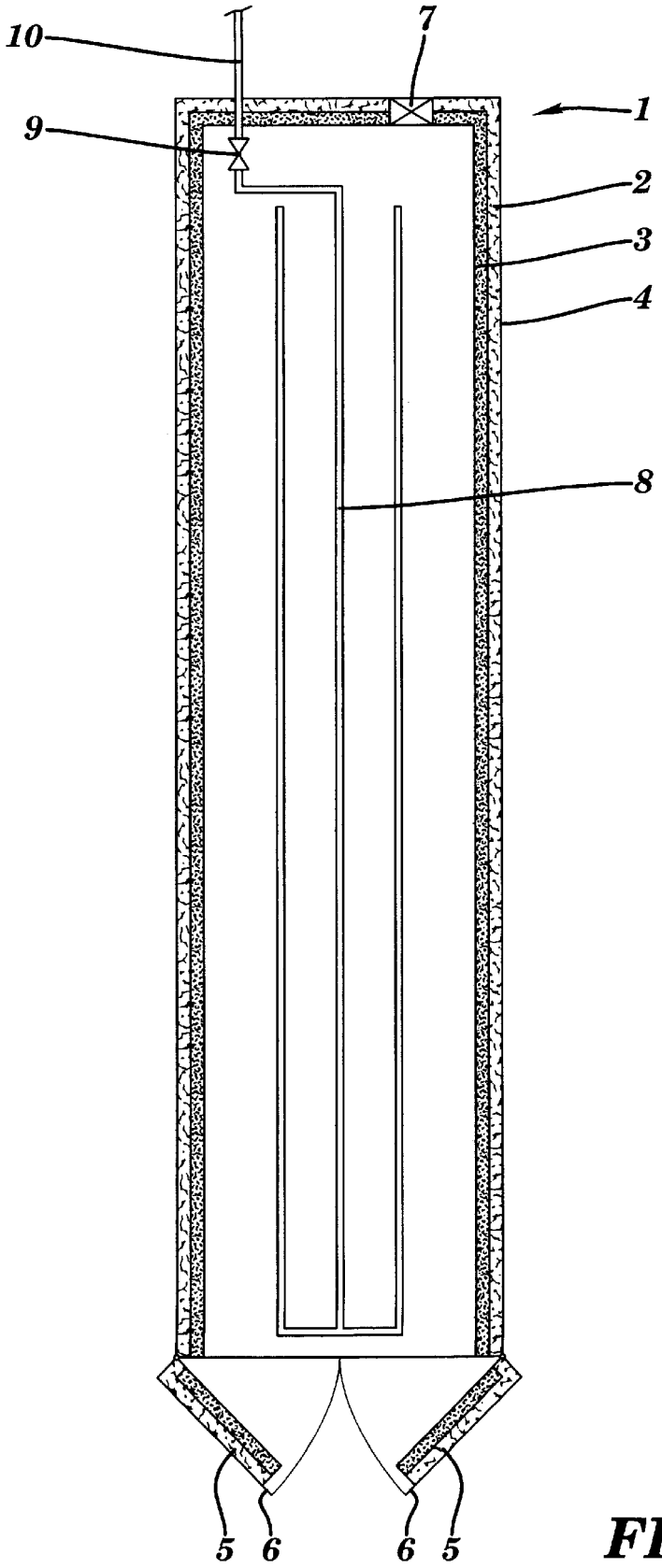
FIG. 1 shows a roof section of a container with additional insulation, a vent door and a $CO_2$ distribution system.

Referring to FIG. 1, the invention is constructed beginning with a commercially available insulated ISO shipping container built with or designed to support a mechanical refrigeration unit The refrigeration unit was removed from the nose 1. The nose 1 was closed and insulated with 8" to 10" of polyurethane insulation foam 2. Four inches of polyurethane foam insulation was added to the bottom side 3 of the container, between and around the cross members, the walls and ceiling 4 on the inside of the container and the doors 5 of the container. Additional closure gaskets were added around the seal of the doors 6 after the insulation was added to insure a proper seal. A hinged vent door 7 which automatically opens when the pressure inside the container increases. The vent door 7 releases the pressure as the cryogenic liquid is added and as the cryogenic liquid sublimates. This was installed in the nose 1 of the container about one inch down from the top of the container box. A cryogenic liquid spray header was installed. The spray head is known as a Transnow $CO_2$ sprayhead 8 and is the subject of U.S. Pat. No. 4,640,460. The sprayhead was installed in the roof of the super insulated container and connected to a valve 9 on the outside of the container where the liquid $CO_2$ line 10 is connected. The said Transnow $CO_2$ spray head has properties and advantages such that it provides the greatest ration of liquid $CO_2$ to solid $CO_2$ product, thus operating at highest available efficiency and reducing the refrigeration cost. It should be understood that there is no intention to limit the scope of the invention to use with a Transnow $CO_2$ spray head, any cryogenic liquid distribution system or solid dry ice could be used as well.

Figure 2:
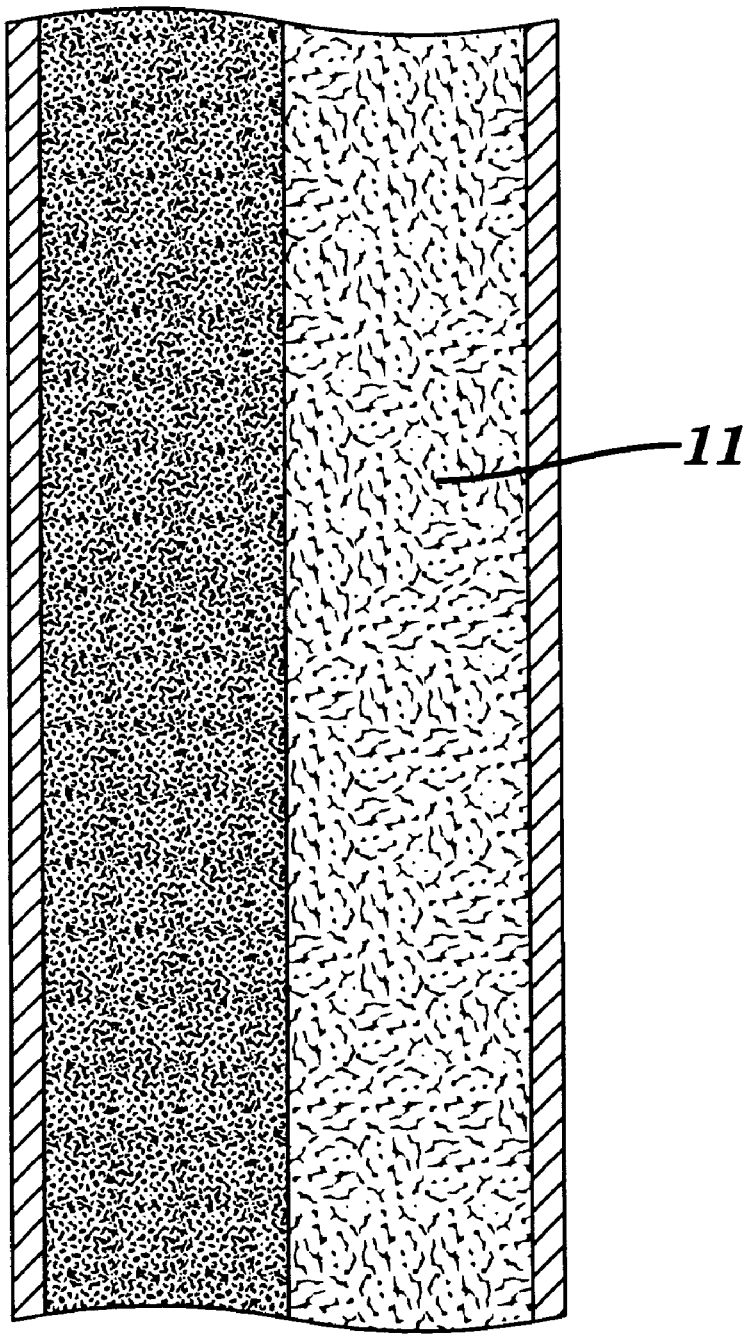
FIG. 2 shows the wall section of a standard ISO shipping container with standard insulation value, and the additional insulation which, when added, will create the super insulated container's insulative value. Standard r-value of a shipping container is in the range of 15 to 20. The super container shown in this figure has r-values of 30 or more.
Figure 3:
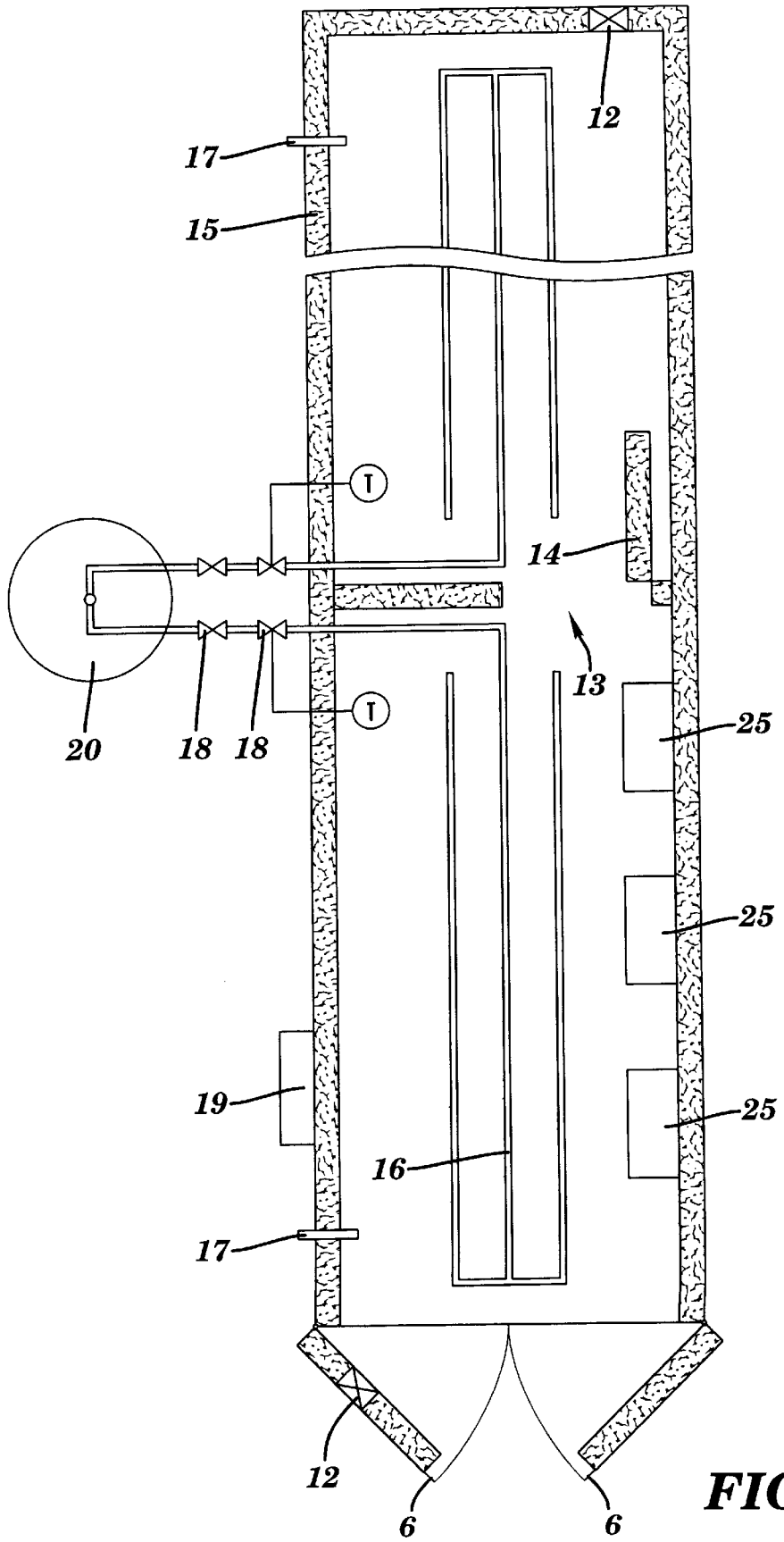
FIG. 3 shows a section of a super freezer/storage container with super insulated walls, a freezer section and a storage section, a cryogenic liquid supply tank, thermostatic valves for the temperature controlled flow of the cryogenic liquid, an electric control panel to turn the system on and off and set the desired interior air temperature, fans for increased heat transfer during the freezing process and temperature probes to read the air temperature inside the two sections.

A key feature of the invention is increasing the r-value of the container walls. FIG. 2 is a cross section of the container wall showing the additional insulation 11.

Figure three shows a cross-section and key features of the freezing and storage container. This container is a standard ISO insulated container to which has been added a vent door 12, at least one interior wall 13 and connecting door 14 and foam insulation 15 is added to all walls and doors such to form super-insulated walls and doors increasing the r-value. A cryogenic temperature control system is added consisting of refrigerant piping 16, temperature probes 17, thermostatic valves 18, an electric control panel 19, and cryogenic storage facility 20.

Operation

The product or material to be frozen is loaded into a freezing section of the freezing and storage super-insulated container which has been pre-cooled to −60° C. It is allowed to cool to ambient temperature and is thus transformed into the super-frozen state. The super-frozen product or material is then transferred to a storage section of the container to await transfer.

The product or material to be shipped is pre-frozen in the super-frozen state is transferred from the storage container and loaded into the super insulated container which has been precooled to −60° C. The loading proceeds in the same manner in that they are loaded into a standard shipping container. In most cases the products are bulk loaded by hand, one on top of the other. The amount of product that should be loaded is also a factor of how long the shipping time will be and the amount of $CO_2$ solid is needed. However, once the pre-frozen product or material has been loaded into the suer insulated container, this super insulated container provides an atmosphere in which the $CO_2$ is distributed and surrounds the frozen products inside the super insulated container. As the $CO_2$ is being distributed a large amount of pressure is being blown into the container box. The effect is something like a blizzard with very high winds. Thus the $CO_2$ snow will fill air pockets and crevices, although the majority of the snow will be piled on top of the products. Once the product is loaded into the super insulated container and injected with the $CO_2$, the super insulated container will be handled the same way all other dry cargo shipping containers are handled. This is in distinction to frozen shipping containers which require monitoring and electrical power hookups. Before injecting the $CO_2$, a calculation is performed to determine the amount of $CO_2$ that will be required to maintain the super frozen state of the product or material until it arrives at its destination or until additional $CO_2$ can be added to the super insulated container. This calculation is based upon the insulative value of the super insulated container, the amount (weight) of pre-frozen products or materials which will be loaded, the relative heat factor of the products or materials and the amount of time the product will be in transit. The super insulated container can be loaded onto a truck chassis and transported to the point of departure such as a ship port, rail yard or other transportation depot. It is then taken off of the truck and put into a holding area awaiting loading onto the ship, train or other conveyance. From the moment the super insulated container is loaded onto the conveyance until its arrival at the destination, no special monitoring or handling is required by the shipper or the shipping line.

When the container arrives at its destination, the interior temperature of the super insulated container can be tested and, if necessary, additional $CO_2$ can be added to provide extra storage time. The products can also be unloaded at this point and placed in cold storage at the destination.

OTHER EMBODIMENTS

This system can be used also with standard frozen products, for example in areas where there is currently no refrigerated shipping service available, but dry container service is available. Further, shipping costs can be often reduced by shipping the container of the subject invention at the dry shipping rate whereas other types of frozen shipping containers require frozen shipping rates.

There are a variety of insulation types which could be used in place of or in addition to polyurethane foam. Any insulation system which raises the r-value of the container above the 15–20 range constituents an additional embodiment of the invention.

Finally, the shipping container could also be used for storage, the storage and freezing container could be also used for shipping and a system comprising a combination of the storage and freezing container and the shipping container are all additional embodiments of the invention.

EXAMPLE 1

Freezing and Storage Container

To the system of example 1 were added five 1 hp fans were added to the rear area and the spray header was separated into two sections. Two temperature probes were added (one in each compartment) to monitor the air temperature. The temperature probes were connected to an electric switch box which allows the desired air temperature to be set inside each compartment. The switches and probes are connected to valves which open and close based on desired temperature setting and the actual air temperature inside each compartment.

Fresh tuna fish were loaded onto racks and the racks were placed inside the freezing section of the container. The doors were closed and the fans and nitrogen supply switches were turned on. Wire temperature probes were placed inside the core meat of the fish. When core temperature reaches around −50° C. everything is turned off and the doors of the container were opened and nitrogen gas was allowed to escape. The fish were taken off the racks and glazed by dipping in water for a few seconds. The glazed fish were then loaded into the super insulated storage area.

EXAMPLE 2

Shipping container

A super insulated shipping container was constructed and pre-frozen tuna were shipped in it from Italy to Japan, arriving in Japan in perfect super frozen state. Details of this example follow.

A standard 40 foot insulated shipping ISO container was purchased from Transnow $CO_2$. The container was modified by building a standard two by four stud wall with a plywood exterior and poly-foam was injected through the plywood and between the two by fours The ceiling and undercarriage was then sprayed with poly-foam adding about 4 inches to all surfaces. The container was then shipped to Italy. There the container was used for freezing and storing tuna during a two month production and gathering period. About 5 metric tons of tuna loins were produced and frozen during that time. The air temperature and the core temperature of the fish was monitored each day. As the temperature rose above −60° C. more $CO_2$ was added, such that product was consistently below −50° C. Optimal results were achieved by periodic additions of large amounts of $CO_2$. When the container was fully loaded with tuna loins and ready to ship approximately 22 Metric Tons of liquid $CO_2$ was added and the whole container was shipped to Japan on the NYK Line, bill of lading number NYKS577080998, on the vessel Osaka Bay. Transit time was 28 days. The overall time between the last injection of $CO_2$ until opening the door of the container in Japan was 36 days. When the center door leading to the super insulated storage compartment was opened there was a large block of frozen $CO_2$ snow inside the compartment. The temperature of that snow was found to be −85° C. The fish had a core temperature of −60° C.

Conclusions, Ramifications, and Scope

Accordingly it can be seen that the instant invention provides a method and apparatus for freezing, storing and shipping super frozen materials or products such as tuna fish in a self contained system that maintains the material or product in a super frozen state for long periods of time.

Advantageously, a preferred embodiment of the present invention enables shipments as small as an individual ISO shipping container (up to approximately 30 metric tons) at a sustained temperature of approximately −50 to −60 degrees C. Moreover, such shipments may be advantageously shipped as dry rather than "reefer" containers which, as discussed hereinabove, enable substantial savings in shipping costs. Additional advantages associated with this technique, include elimination of pollution generated by diesel operated mechanical refrigeration systems, and substantial elimination of opportunities for mechanical breakdown, human error and the need for servicing before, after and en-route. Moreover, capital equipment costs are substantially reduced due to the lack of necessity for expensive mechanical refrigeration systems and generator sets, etc. Lost shipments (i.e., due to equipment failure and human error) may be substantially reduced relative to mechanically refrigerated units.

Although the description above contains many specificities, these should not be construed as limiting the scope of the invention but as merely providing illustrations of some of the presently preferred embodiments of this invention. Various other embodiments and ramifications are possible within it's scope.

Thus the scope of the invention should be determined by the appended claims and their legal equivalents, rather than by the examples given.

What is claimed is:

1. An apparatus for shipping product disposed at a super-frozen temperature of less than or equal to about −50 degrees C., the apparatus comprising:

a container having walls insulated to an r-value greater than or equal to about 20;

a spray head disposed within said container, said spray head adapted to spray cryogenic fluid within said container;

at least one coupling disposed in fluid communication with said spray head, said at least one coupling adapted for alternate engagement and disengagement with an external cryogenic fluid supply;

said container being selectively sealable to form a self-contained, dry module;

said container being adapted to receive therein product disposed at the super-frozen temperature and to maintain the product at the super-frozen temperature during shipment thereof.

2. The apparatus of claim 1 which is a commercially available insulated shipping container to which is added additional insulation, and a cryogenic dispersal system.

3. The apparatus of claim 1, wherein said shipping container further comprises poly-foam insulation, a $CO_2$ sprayhead, a liquid $CO_2$ dispersal system and door seals wherein materials or products contained therein are maintainable at or below the super-frozen temperature.

4. The apparatus of claim 3, which further comprises multiple $CO_2$ sprayheads and a temperature regulation system having one or more temperature probes connected to switches and valves which control the dispersal of $CO_2$.

5. A method for shipping product disposed at a super-frozen temperature of less than or equal to about −50 degrees C., the method comprising the steps of:

(a) providing product disposed at the super-frozen temperature;

(b) providing a modular shipping container adapted to maintain the product at the super-frozen temperature, the modular shipping container having:

walls insulated to an r-value greater than or equal to about 20;

a spray head disposed therein;

at least one coupling disposed in fluid communication with the spray head;

said container being selectively sealable to form a self-contained, dry module;

(c) placing the product into the modular shipping container;

(d) engaging an external cryogenic fluid supply with the at least one coupling, wherein cryogenic fluid is communicated from the external cryogenic fluid supply to the spray head and discharged into the container and onto the product;

(e) disengaging the external cryogenic fluid supply from the at least one coupling;

(f) sealing the container to form a self-contained, dry module; and (g) transporting the modular shipping container to a destination wherein the product is provided at the destination at the super-frozen temperature.

6. The method of claim 5 comprising:

a self contained shipping container comprises a commercially available insulated container with additional insulation and a cryogenic dispersal system;

placing super-frozen product or material to be shipped in the self contained container;

shipping self-contained shipping container with super-frozen product or material to a remote venue.

7. The method of claim 5, in which the super frozen product or material is glazed with water prior to shipment.

8. A portable, modular apparatus for freezing and storing fish at a super-frozen temperature of less than or equal to about −50 degrees C., to preserve the fish at sushi-quality, the apparatus comprising:

one or more containers;

a refrigeration system disposed integrally with said one or more containers, said refrigeration system being adapted to freeze product disposed within said apparatus to the super-frozen temperature;

said apparatus adapted for being shipped to a destination for deployment at the destination to freeze and store fish at the super-frozen temperature, and for being subsequently re-shipped to an other destination for re-deployment.

9. The apparatus of claim 8, wherein said one or more containers further comprises a first section adapted for freezing the fish and a second section adapted for storing the fish at the super-frozen temperature.

10. The apparatus of claim 9, further comprising: walls insulated to an r-value greater than about 20;

a plurality of fans to disperse the cryogenic fluid emitted from said spray head; and a control system to regulate the temperature during freezing and during storing.

11. A method for freezing and storing fish at a super-frozen temperature of less than or equal to about −50 degrees C., to preserve the fish at sushi-quality, the method comprising the steps of:

(a) providing a modular, portable apparatus comprising:

one or more containers;

a refrigeration system disposed integrally with said one or more containers, said refrigeration system being adapted to freeze product disposed within said apparatus to the super-frozen temperature;

said portable apparatus adapted for being shipped to a destination for deployment at the destination to freeze and store fish at the super-frozen temperature, and for being subsequently reshipped to an other destination for re-deployment;

the one or more containers having a first section adapted for freezing the fish and a second section adapted for storing the fish at the super-frozen temperature;

(b) loading the fish into the first section and retaining the fish therein until the fish reaches the super-frozen temperature; and (c) transferring the fish from the first section to the second section, wherein the fish are maintained at the super-frozen temperature in a substantially preserved state suitable for subsequent consumption as sushi.

12. The method of claim 11, wherein the refrigeration system further comprises:

a cryogenic fluid dispersal system having a spray head disposed within at least one of said first section and said second section, said spray head adapted to spray cryogenic fluid within said at least one of said first section and said second section.

13. The method of claim 12, wherein the container further comprises:

a plurality of fans to disperse the cryogenic fluid emitted from said spray head; and a control system to regulate the temperature during the freezing and during the storing processes.

14. The method of claim 11, further comprising the step of (d) glazing the fish with water after said freezing step (b).

15. A method for providing sushi-quality fish harvested at a first location, to a distinct second location, said method comprising the steps of:

(a) providing a portable, modular freezer adapted to freeze fish to a super-frozen temperature of less than or equal to about −50 degrees C.;

(b) transporting the modular freezer to the first location;

(c) loading the harvested fish into the modular freezer and retaining the fish within the modular freezer until the fish reaches the super-frozen temperature;

(d) providing a modular shipping container adapted to maintain the fish at the super-frozen temperature;

(e) transferring the fish from the modular freezer to the modular shipping container; and (f) shipping the modular shipping container to the second location wherein the fish are provided at the second location at the super-frozen temperature in a substantially preserved state suitable for use as sushi.

16. The method of claim 15, wherein the modular freezer further comprises:

a first compartment for freezing the fish to the super-frozen compartment, and a second compartment for storing the fish at the super-frozen temperature, modular freezer having a cryogenic fluid dispersal system including fans linked to a temperature monitoring and control system;

said loading step (c) further comprising placing fish in the first freezing compartment until the fish reaches the super-frozen temperature, and transferring the super-frozen fish to the second compartment for storage.

17. The apparatus of claim 9, wherein said refrigeration system further comprises:

a cryogenic fluid dispersal system having a spray head disposed within at least one of said first section and said second section, said spray head adapted to spray cryogenic fluid within said at least one of said first section and said second section.

18. A method for providing a substantially continuous stream of sushi-quality frozen fish from one or more first locations, to a distinct second location, said method comprising the steps of:

(a) providing a portable, modular freezer adapted to freeze fish to a super-frozen temperature of less than or equal to about −50 degrees C., the modular freezer adapted for being sequentially transported to various ones of the one or more first locations;

(b) transporting the modular freezer to one of the one or more first locations;

(c) providing a plurality of modular shipping containers at the one or more first locations, each one of the plurality of modular shipping containers being adapted to maintain the fish at the super-frozen temperature, and having a size and shape for retaining a load of about 20 metric tons or less of fish therein;

(d) loading the harvested fish into the modular freezer and retaining the fish within the modular freezer until the fish reaches the super-frozen temperature, and transferring the super-frozen fish from the modular freezer to one or more of the plurality of modular shipping containers;

(e) shipping the one or more modular shipping containers as they are loaded, to the second location; and (f) repeating said loading step (d) and said shipping step (e), wherein a substantially continuous stream of fish is provided to the second location at the super-frozen temperature in a substantially preserved state suitable for use as sushi, in increments of about 20 metric tons or less.

19. The method of claim 18, further comprising the steps of:

(g) transporting the modular freezer and a plurality of the shipping containers to an other of the one or more first locations; and (h) reiterating said loading step (d) and said shipping step (e).

20. The apparatus of claim 1, wherein in said walls are insulated to an r-value greater than or equal to about 30.

21. The apparatus of claim 1, wherein said container is sized and shaped to standard ISO container dimensions.

22. The method of claim 5, wherein the modular shipping container has a size and shape of one or more modular ISO shipping containers and the modular shipping container is transported on board a vehicle adapted to receive one or more modular ISO shipping containers thereon.

23. The apparatus of claim 8, wherein said one or more containers have a size and shape of a modular ISO shipping container, and said apparatus is adapted for being shipped to a destination on board a vehicle adapted to receive modular ISO containers thereon.

24. The method of claim 11, wherein the one or more containers have a size and shape of a modular ISO shipping container, and said portable apparatus is adapted for being shipped to a destination on board a vehicle adapted to receive modular ISO containers thereon.

25. The method of claim 15, wherein the modular freezer has a size and shape of one or more modular ISO shipping containers and the modular shipping container is shipped to the second location on board a vehicle adapted to receive one or more modular ISO shipping containers thereon, the modular shipping container has a size and shape of one or more modular ISO shipping containers.

26. The method of claim 18, wherein the portable, modular freezer and the plurality of modular shipping containers have a size and shape of one or more modular ISO shipping containers, and the one or more modular ISO shipping containers are shipped on board a vehicle adapted to receive one or more modular ISO shipping containers thereon.

* * * * *